United States Patent [19]

Sherburne

[11] 4,295,977

[45] Oct. 20, 1981

[54] NONIONIC TEXTILE SOFTENER COMPOSITION

[75] Inventor: Edwin C. Sherburne, Wilmington, Del.

[73] Assignee: ICI Americas Inc., Wilmington, Del.

[21] Appl. No.: 148,063

[22] Filed: May 12, 1980

Related U.S. Application Data

[63] Continuation-in-part of Ser. No. 123,874, Feb. 22, 1980, abandoned.

[51] Int. Cl.[3] ..... D06M 13/02; D06M 13/18

[52] U.S. Cl. ..... 252/8.9; 252/8.6

[58] Field of Search ..... 252/8.9

[56] References Cited

U.S. PATENT DOCUMENTS

| | | | |
|---|---|---|---|
| 3,240,819 | 3/1966 | Gartner et al. | 252/8.9 |
| 3,632,396 | 1/1972 | Zamora | 252/8.9 |
| 3,686,025 | 8/1972 | Morton | 252/8.9 |
| 3,979,306 | 9/1976 | Arai et al. | 252/8.9 |
| 4,141,841 | 2/1979 | McDanald | 252/8.9 |
| 4,170,565 | 10/1979 | Flesher et al. | 252/8.9 |

*Primary Examiner*—Joseph L. Schofer
*Assistant Examiner*—Maria Parrish Tungol

[57] ABSTRACT

Disclosed are textile treating compositions comprising (1) from about 70% to about 80% by weight of a blend of (i) a mixture of linear and branched $C_{18}$ to $C_{32}$ monohydric alcohols and (ii) a mixture of $C_{24}$ to $C_{40}$ aliphatic hydrocarbons, said blend of alcohols and hydrocarbons having a melting point between about 110° F. and about 122° F.; (2) from about 15% to about 25% by weight of the etherification reaction product of from about 30 to about 50 mols of ethylene oxide with an amount of blend (1) sufficient to furnish one mol of hydroxyl groups; and (3) from about 3% to about 10% by weight of polyoxyethylene ether of oxo decyl alcohol wherein the mol ratio of oxyethylene groups to oxo decyl alcohol groups is from about 5 to about 10.

10 Claims, No Drawings

NONIONIC TEXTILE SOFTENER COMPOSITION

This application is a continuation-in-part of application Ser. No. 123,874 filed Feb. 22, 1980, now abandoned.

This invention relates to compositions for treating textile materials. More particularly, this invention relates to nonionic aqueous dispersions which are suitable for imparting softness to textile material and to textile material treated with such nonionic aqueous dispersions.

Softness is very frequently required in textile materials, particularly in fabrics used for clothing. The natural waxy, oily, or fatty protective coatings of natural fibers are often removed during the process of scouring and bleaching of these fibers. The fibers generally become harsh when these lubricants are removed, and fabrics formed from these fibers display an undesirable hand. In addition, certain coloring matters are prone to impart a dryness and an unpleasantness of hand to the fabric. Frequently, softeners are applied to fibers themselves to aid in the mechanical handling of these fibers since it is very difficult to spin any fiber from which the natural oils or waxes have been removed or, as in the case of man-made fibers, those which do not contain a natural lubricant. Frequently, these treatments result in the production of a relatively stiff fabric which is harsh to the feel and less desirable commercially then fabrics possessing a soft hand. As a result, the industry has resorted to the use of several types of compounds for softening of finished fabric and for imparting thereto increased lubricity. The situations with which this invention is particularly concerned are those in which softeners are applied to yarn or fabric as a finish to impart one or more of the following: softness, smoothness, lubricity, fullness, suppleness, flexibility and sewability.

There are a great many nonionic compositions described in the literature for softening textile materials. These nonionic textile softening compositions possess many advantages, but many also suffer from several disadvantages. Many of the nonionic softeners are waxy or gummy in nature making them difficult to weigh or measure, to mix or disperse with other textile agents, and to place in a form such as an aqueous dispersion, which may be readily handled and applied to textiles. Many softener compositions when diluted with water to form products of 10% to 30% activity result in viscous liquids or pastes that are difficult to pour or pump and which can not easily be diluted further in cold water. Many of the nonionic softeners are readily capable of imparting softness to textile material treated therewith, but suffer from the disadvantage that textile material treated with the softeners tends to yellow on ageing or when exposed to elevated temperatures. Many of the textile compositions do not suffer from the aforementioned disadvantages but suffer from another disadvantage, such as being too costly, so that they are not suitable for use in the industry. For these reasons, there is a need in the industry for a nonionic textile softening composition which is economical, imparts improved softness to textile material treated therewith, does provide improved resistance to yellowing on ageing and heating to elevated temperatures, and is readily dispersible in water.

It has now been discovered that this need may be met by an improved nonionic textile treating composition comprising: (1) from about 70% to about 80% by weight of a blend of (i) a mixture of linear and branched $C_{18}$ to $C_{32}$ aliphatic, monohydric alcohols and (ii) a mixture of $C_{24}$ to $C_{40}$ aliphatic hydrocarbons, said blend of alcohols and hydrocarbons having a melting point between about 110° F. and about 122° F.; (2) from about 15% to about 25% by weight of the etherification reaction product of about 30 to about 50 mols of ethylene oxide with an amount of blend (1) sufficient to furnish one mol of hydroxyl groups; and (3) from about 3% to about 10% by weight of polyoxyethylene ether of oxo decyl alcohol wherein the mol ratio of oxyethylene groups to oxo decyl alcohol groups is from about 5 to about 10. The nonionic textile treating compositions of this invention may be converted to fluid, pourable, easily handled dispersions of 10% to 30% dispersed solids that dilute readily in cold water for application to textile materials.

The particular monohydric alcohols and hydrocarbons and amounts thereof which may be used to form component (1) are not critical, provided the alcohols contain from eighteen to thirty-two carbon atoms, the hydrocarbons contain from twenty-four to forty carbon atoms, and the blend of alcohols and hydrocarbons has a melting point between about 110° F. and 122° F. In most instances, the blend (1) will contain from about 30% to about 35% by weight of linear alcohols, from about 30% to about 35% by weight of branched alcohols, and from about 30% to about 38% by weight of hydrocarbons. A particular preferred blend (1) is available from Ethyl Corporation under the trademark EPAL 20+. A typical formulation of blend (1) is:

| Component | Weight Percent |
|---|---|
| $C_{18}$ OH | 4 |
| $C_{20}$ OH | 20 |
| $C_{22}$ OH | 13 |
| $C_{24}$ OH | 10 |
| $C_{26}$ OH | 8 |
| $C_{28}$ OH | 5 |
| $C_{30}$ OH | 3 |
| $C_{32}$ OH | 3 |
| Hydrocarbons ($C_{24}$ to $C_{40}$) | 34 |
| | 100 |

A typical formulation contains equal amounts of linear and branched alcohols.

Component (2) is the polyoxyethylene ether of blend (1) described above. This ether may be prepared by reacting from about 30 to about 50 mols, preferably from about 38 to 42 mols, of ethylene oxide with each mol of hydroxyl groups in blend (1). An illustrative example of preparing such ether is as follows:

EXAMPLE A

A steam heated autoclave reactor is charged with 112 pounds of EPAL 20+alcohol and 485 grams of sodium hydroxide powder under a flow of nitrogen gas. The autoclave is purged three times with nitrogen gas and heated to 140° C. 389 pounds of ethylene oxide are charged to the autoclave. The pressure in the autoclave is 50 psig. The contents of the autoclave are maintained at 140° C. until the pressure has decreased to 0 psig, indicating that the reaction of the ethylene oxide with EPAL 20+alcohol is complete. 485 grams of 85% phosphoric acid are added to neutralize the sodium hydroxide catalyst. The resulting polyoxyethylene (40)

EPAL 20+alcohol is filtered and cooled to room temperature.

Component (3) is the polyoxyethylene ether of decyl alcohol. This ether may be prepared by reacting from about 5 mols to about 10 mols of ethylene oxide with one mol of oxo decyl alcohol under etherification conditions, such as in the presence of a basic etherification catalyst like sodium hydroxide.

The compositions of the present invention may be applied to the textile material in any convenient form and manner used in the art for treating textile materials with nonionic softening compositions. Preferably, however, the compositions are applied to textile material as an aqueous dispersion by dipping and passing between squeeze rolls or spraying followed by drying to remove the water added. The concentration of such dispersion should be sufficient to deposit an effective amount of the active material on the fibers. The dispersions most frequently used contain from about 0.1% to 10.0% by weight of dispersed solids based on the total weight of the dispersion. The amount used in the bath will depend on the wet pick-up by the fabric, which is determined by fabric construction and application details (squeeze roll pressure, etc.). The optium amount to be used in any particular case will vary depending on the type of fibers involved. However, the amount deposited will usually fall in the range of 0.1% to 3% active material based on the weight of fibers.

The nonionic textile softeners of this invention may be used with any natural or synthetic fibers or blends thereof, such as cotton, wool, polyester, polyamide, acrylic, modacrylic, polyolefin, and cellulose acetate fibers.

The invention will be better understood from a consideration of the following examples which are presented for illustrative purposes. All parts and percentages are by weight unless otherwise specified.

EXAMPLE 1

1700 pounds of EPAL 20+alcohol, 425 pounds of the product of Example A and 112 pounds of polyoxyethylene (8) decyl alcohol are charged to a suitable container under a nitrogen blanket and heated to 75° C. The resulting mixture is stirred at 75° C. for one hour and then cooled to room temperature. The resulting blend may be sold as such or it may be diluted with water and sold as a pumpable aqueous dispersion.

EXAMPLE 2

76 parts of EPAL 20+alcohol having a melting point of 115° F., 19 parts of the etherification reaction product of ethylene oxide and EPAL 20+alcohol wherein 40 mols of ethylene oxide are reacted with each mol of hydroxyl in the EPAL 20+alcohol, and 5 parts of polyoxyethylene (8) decyl alcohol are blended together. 15 parts of the blend are added to 85 parts of water to form an aqueous emulsion. 1000 ppm of 6-acetoxy-2,4-dimethyl-m-dioxane are added as a preservative.

EXAMPLE 3

The emulsion of Example 2 is diluted with water to form an emulsion containing 0.5% dispersed solids. The dilute emulsion is then padded onto cotton crash toweling, a 65%/35% polyester/cotton blend fabric, Orlon acrylic fabric, 100% polyester fabric, and spun nylon to furnish 0.25% of solids pick-up based on the weight of fabrics. The treated fabrics each exhibited excellent softness or hand and excellent resistance to yellowing when suspended in an oven and heated to 325° F. for fifteen minutes.

EXAMPLE 4

The aqueous emulsion prepared in Example 2 is diluted with water to yield an emulsion containing 1.25% dispersed solids and 98.75% water. The emulsion is padded onto cotton crash toweling at a pick-up of 1% dispersed solids based on the weight of fabric. The cotton has excellent hand and resistance to scorching when pressed between metal plates heated to 425° F. for thirty seconds.

EXAMPLE 5

74 parts of a mixture of equal parts of (1) aliphatic hydrocarbon containing from 24–40 carbon atoms, (2) linear monohydric aliphatic alcohols containing from 18–32 carbon atoms, and (3) branched monohydric aliphatic alcohols containing from 18–32 carbon atoms, 20 parts of the etherification reaction product of said mixture with ethylene oxide wherein 40 mols of ethylene oxide are reacted with each mol of hydroxyl groups in the mixture, and 6 parts of polyoxyethylene (7) decyl alcohol are blended together and dispersed in water. The resulting dispersion contains 1% dispersed solids and 99% water. The dispersion is padded onto 100% polyester fabric to give a pick-up of 0.5% solids based on the weight of fabric. The treated fabric shows a very good hand and excellent resistence to yellowing when heated to 325° F. for 15 minutes.

EXAMPLE 6

Melt 17 parts of EPAL 20+alcohol in a suitable container and add 4.25 parts of the polyoxyethylene (40) EPAL 20+alcohol prepared in Example A. The resulting blend is heated to 60°–80° C. and 1.12 parts of polyoxyethylene (8) decyl alcohol are slowly added. The blend is stirred until uniform.

EXAMPLE 7

15 parts of the blend prepared in Example 6 are melted at 180° F. In a suitable mixing tank, heat 85 parts by weight of water to 180° F. While stirring the water, slowly add the melted blend and stir until uniform. Then allow the product to cool, but maintain agitation until the temperature reaches about 100° F. in order to prepare a softener with maximum fluidity that can be easily poured or pumped. This 15% active softener dispersion can be further diluted for application to fabrics simply by stirring into cold or hot water.

EXAMPLE 8

A textile treating bath is prepared by dispersing 5.3 parts of the 15% active dispersion prepared in Example 7 in 94.7 parts of water. This dilute dispersion is applied to spun Orlon acrylic fabric by means of a padder, obtaining a wet pick-up of 50%. For every 100 grams of dry fabric the pick-up is 50 grams of dispersion after the fabric is immersed and then run through the squeeze rolls at 35 pounds per square inch gauge pressure. The fabric contains 0.3975% (approximately 0.4%) of softener solids based on the fabric weight. The treated fabric is allowed to dry at room temperature. After drying the fabric has a very soft, smooth, silky feel or hand.

Although this invention has been described with reference to specific compositions and textile materials, it will be apparent that still other different and equivalent compositions and textile materials may be substituted for those specifically described, all within the sphere and scope of this invention.

Having described the invention, what is desired to be secured by Letters Patent is:

1. A nonionic textile softening composition comprising:

(1) from about 70% to about 80% by weight of a blend of (i) a mixture of linear and branched $C_{18}$ to $C_{32}$ monohydric alcohols and (ii) a mixture of $C_{24}$ to $C_{40}$ hydrocarbons, said blend of alcohols and hydrocarbons having a melting point between 110° F. and about 122° F.;

(2) from about 15% to about 25% by weight of the etherification reaction product of ethylene oxide and blend (1) where from about 30 to about 50 mols of ethylene oxide are reacted with each mol of hydroxyl groups in blend (1); and (3) from about 3% to about 10% by weight of polyoxyethylene ether of oxo decyl alcohol wherein the mol ratio of oxyethylene groups to oxo decyl alcohol groups is from about 5 to about 10.

2. A nonionic textile softening composition of claim 1 wherein (2) contains about 40 mols of ethylene oxide per mol of hydroxyl groups in blend (1).

3. A nonionic textile softening composition of claim 2 wherein (3) has a mol ratio of oxyethylene groups to oxo decyl alcohol groups of about 8.

4. A nonionic textile softening composition of claim 2 which comprises about 76% by weight of (1), about 19% by weight of (2) and about 5% by weight of polyoxyethylene ether of oxo decyl alcohol wherein the mol ratio of oxoyethylene groups to oxo decyl alcohol groups is about 8.

5. A nonionic textile softening composition comprising an aqueous emulsion of about 85% by weight of water and about 15% by weight of the composition of claim 4.

6. A nonionic textile softening composition of claim 1 wherein (3) has a mol ratio of oxyethylene groups to oxo decyl alcohol groups of about 8.

7. A nonionic textile softening composition of claim 1 which comprises from about 74% to about 78% by weight of (1), from about 17% to about 21% by weight of (2), and from about 3% to about 7% by weight of (3).

8. A nonionic textile softening composition comprising an aqueous emulsion of the composition of claim 7 wherein said emulsion contains from about 80% to 90% by weight of water.

9. A nonionic textile softening composition comprising an aqueous emulsion of the composition of claim 1.

10. Textile material which has been treated with the composition of claim 9.

* * * * *